US007798782B2

(12) United States Patent
Heo

(10) Patent No.: US 7,798,782 B2
(45) Date of Patent: Sep. 21, 2010

(54) APPARATUS AND METHOD FOR CONTROLLING OPERATION OF RECIPROCATING COMPRESSOR

(75) Inventor: Kyung-Bum Heo, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 972 days.

(21) Appl. No.: 11/589,769

(22) Filed: Oct. 31, 2006

(65) Prior Publication Data

US 2007/0098566 A1 May 3, 2007

(30) Foreign Application Priority Data

Nov. 1, 2005 (KR) ..... 10-2005-0103932

(51) Int. Cl.
*F04B 49/06* (2006.01)

(52) U.S. Cl. ..... 417/44.1; 417/44.11; 417/417

(58) Field of Classification Search ..... 417/417, 417/44.1, 44.11; 123/500
See application file for complete search history.

(56) References Cited

U.S. PATENT DOCUMENTS 4,027,211 A * 5/1977 Omura et al. ..... 318/127
5,249,933 A * 10/1993 Moody ..... 417/404
5,980,211 A * 11/1999 Tojo et al. ..... 417/45
6,753,665 B2 * 6/2004 Ueda et al. ..... 318/135
6,857,858 B2 * 2/2005 Jeun ..... 417/45
2001/0002977 A1 * 6/2001 Morita et al. ..... 417/417
2002/0051710 A1 * 5/2002 Yoo et al. ..... 417/44.11
2002/0064461 A1 * 5/2002 Yoo et al. ..... 417/44.1
2002/0064463 A1 * 5/2002 Park et al. ..... 417/44.1
2005/0031470 A1 * 2/2005 Lee ..... 417/416

FOREIGN PATENT DOCUMENTS

CN 1548738 11/2004
JP 2000-280100 10/2000
KR 10-2003-0024253 3/2003

OTHER PUBLICATIONS

Korean Office Action dated Nov. 1, 2006.
Chinese Office Action dated Feb. 6, 2009.

* cited by examiner

*Primary Examiner*—Devon C Kramer
*Assistant Examiner*—Todd D Jacobs
(74) *Attorney, Agent, or Firm*—Ked & Associates LLP

(57) ABSTRACT

An apparatus and method for controlling an operation of a reciprocating compressor are disclosed. The apparatus for controlling an operation of a reciprocating compressor includes: a TDC/BDC detecting unit for detecting a TDC and a BDC of the reciprocating compressor; and a controller for independently controlling the TDC and the BDC so as to fit each reference position based on the detected TDC and BDC. Efficiency of the reciprocating compressor can be enhanced by independently controlling a top dead center and a bottom dead center.

9 Claims, 2 Drawing Sheets

APPARATUS AND METHOD FOR CONTROLLING OPERATION OF RECIPROCATING COMPRESSOR

RELATED APPLICATION

The present disclosure relates to subject matter contained in priority Korean Application No. 10-2005-0103932, filed on Nov. 1, 2005, which is herein expressly incorporated by reference in its entirety.

BACKGROUND OF THE INVENTION

1. Field of the Invention

The present invention relates to an apparatus and method for controlling an operation of a reciprocating compressor and, more particularly, to an apparatus and method for controlling an operation of a reciprocating compressor capable of independently controlling top and bottom dead centers.

2. Description of the Related Art

In general, a reciprocating compressor can vary compression capacity by changing a compression ratio of a reciprocating compressor by controlling a voltage applied to a motor within the compressor.

The reciprocating compressor will be described in detail with reference to FIG. 1

FIG. 1 is a schematic block diagram showing an apparatus for controlling operations of a reciprocating compressor according to a related art.

As shown in FIG. 1, the related art apparatus for controlling an operation of a reciprocating compressor includes a reciprocating compressor having certain compression capacity as a piston positioned therein moves in a vertical direction by a voltage that controls a stroke according to a stroke command value (stroke reference value); a voltage detection unit 12 for detecting a voltage applied to the reciprocating compressor; a current detection unit 11 for detecting current flowing at the reciprocating compressor; a microcomputer 13 for calculating the stroke estimate value based on the detected voltage and current, and outputting a switching control signal based on the comparison result of the calculated stroke estimate value and the stroke command value; and a triac (Tr1) switched on or off according to the switching control signal to thus control a flow of current of general AC input power source.

The apparatus for controlling an operation of the reciprocating compressor controls a motor of the reciprocating compressor by turning on or off general AC input power (AC 220V) by controlling an ON/OFF operation of the triac Tr1.

Herein, because the general AC input power is an AC voltage, voltage (positive (+) voltage) of one half period of the general AC input power is used to control a position of a top dead center (TDC) of the piston and voltage (negative (−) voltage) of the other half period of the general AC input power is used to control a position of a bottom dead center (BDC) of the piston.

The TDC refers to a position of an upper surface of the piston when the reciprocating compressor performs a suction stroke (namely, when the piston is lifted up to its maximum level. The BDC refers to a position of the upper surface of the piston when the reciprocating compressor is in a suction stroke (namely, when the piston is lowered to its maximum level. The distance between the TDC and BDC is called a stroke.

Based on the position of an initial state of the piston, as an amount of voltage (+ voltage) of one half period increases, the TDC is raised, and as an amount of voltage of the other half period increases, the BDC is lowered.

Herein, a time point at which the triac Tr1 is turned on to supply the voltage (+) voltage of one half period to control the TDC is called a TDC firing angle, and a time point at which the triac Tr1 is turned on to supply the voltage (− voltage of the other half period to control the BDC is called a BDC firing angle.

The related art apparatus and method for controlling an operation of the reciprocating compressor has a problem that the TDC and BDC cannot be independently controlled because the TDC firing angle and the BDC firing angle are controlling to be the same always.

In addition, because the TDC and BDC cannot be independently controlled, the size of the stroke of the reciprocating compressor cannot be maximized, failing to obtain maximum compression efficiency.

SUMMARY OF THE INVENTION

Therefore, an object of the present invention is to provide an apparatus and method for controlling an operation of a reciprocating compressor capable of enhancing efficiency of the reciprocating compressor by controlling a top dead center (TDC) so as to fit a pre-set position and independently controlling the TDC and a bottom dead center (BDC) so as to make the BDC fit a desired position.

To achieve these and other advantages and in accordance with the purpose of the present invention, as embodied and broadly described herein, there is provided an apparatus for controlling an operation of a reciprocating compressor including: a TDC/BDC detecting unit for detecting a TDC and a BDC of the reciprocating compressor; and a controller for independently controlling the TDC and the BDC so as to fit each reference position based on the detected TDC and BDC.

To achieve the above object, there is also provided a method for controlling an operation of a reciprocating compressor comprising: detecting a TDC and a BDC of a piston of the reciprocating compressor; and independently controlling the TDC or the BDC of the piston of the reciprocating compressor so as to fit first and second reference positions, respectively.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The apparatus and method for controlling an operation of a reciprocating compressor capable of improving efficiency of a reciprocating compressor by controlling a top dead center (TDC) and independently controlling the TDC and a bottom dead center (BDC) to make the BDC fit a desired position according to the present invention will now be described with reference to FIGS. 2 to 4.

First, power mentioned hereinafter is, for example, 220V 60 Hz. Preferably, the apparatus and method for controlling an operation of the reciprocating compressor does not include a capacitor matched to a reactance of a motor of the reciprocating.

Figure 1:
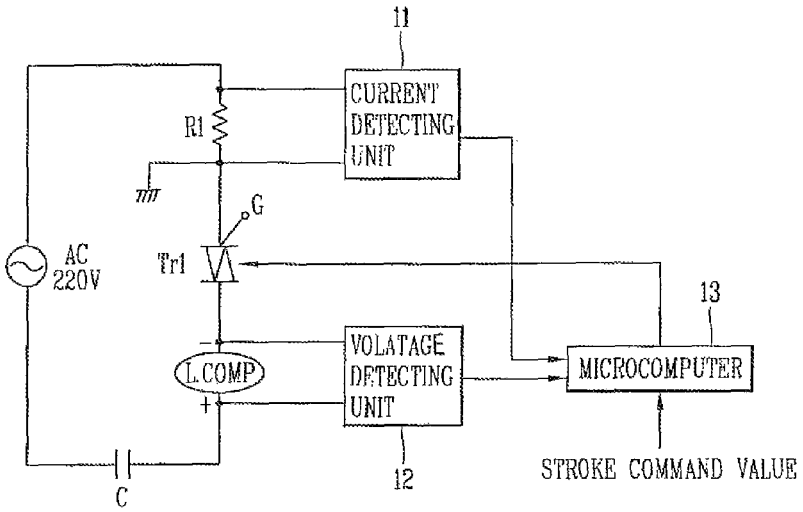
FIG. 1 RELATED ART
FIG. 1 is a block diagram showing an apparatus for controlling an operation of a reciprocating compressor according to the related art.
Figure 2:
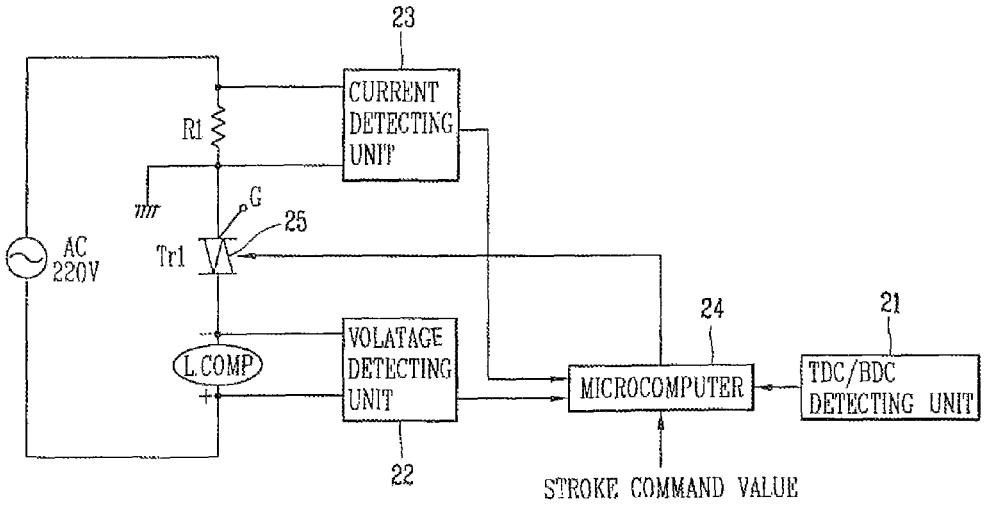
FIG. 2 is a block diagram showing an apparatus for controlling an operation of a reciprocating compressor according to the present invention.

FIG. 2 is a block diagram showing an apparatus for controlling an operation of a reciprocating compressor according to the present invention.

As shown in FIG. 2, the apparatus for controlling an operation of a reciprocating compressor includes: a TDC/BDC detecting unit 21 for detecting a TDC and a BDC of a reciprocating compressor; and a controller for independently controlling the TDC and the BDC so as to fit each reference position based on the detected TDC and BDC.

The controller controls the TDC to fit the first reference position based on the detected TDC and BDC and then controls the BDC to fit a second reference position.

The controller independently controls a TDC firing angle and a BDC firing angle to make the TDC fit the first reference position and the BDC fit the second reference position.

The controller controls the BDC to fit the second reference position based on the detected TDC and BDC and then independently controls the TDC to fit the first reference position.

The controller controls the TDC to fit the first reference position based on the detected TDC and BDC, and at the same time, independently controls the BDC to fit the second reference position.

The controller includes voltage and current detection units 22 and 23 for detecting voltage applied to the reciprocating compressor and current flowing at the reciprocating compressor; a microcomputer 24 for calculating a stroke estimate value based on the detected voltage and current, and outputting a switching control signal based on a result obtained by comparing the calculated stroke estimate value and a stroke command value; and a switch 25 switched on or off according to the outputted control signal to control the TDC or BDC.

The reference position is previously set in the form of a look-up table in a storage unit (not shown) by a user or previously stored in a storage unit (not shown) after being calculated by the microcomputer.

The switch 25 is a thyrister that controls current according to the switching control signal and input AC power.

The operation of the apparatus for controlling an operation of the reciprocating compressor according to the present invention will now be described in detail.

Figure 3:
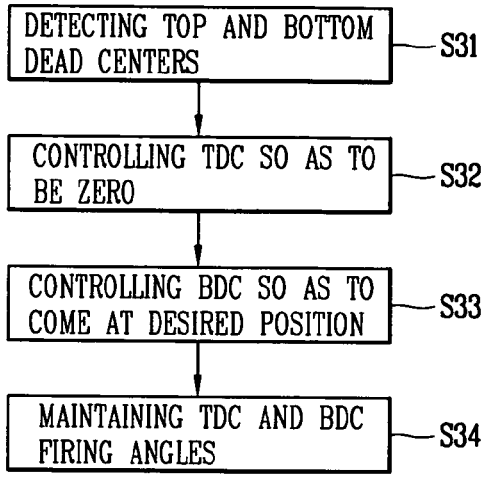
FIG. 3 is a flow chart showing a method for controlling the operation of the reciprocating compressor according to the present invention.

FIG. 3 is a flow chart showing a method for controlling the operation of the reciprocating compressor according to the present invention.

As shown in FIG. 3, the method for controlling an operation of the reciprocating compressor according to the present invention includes: detecting a TDC and a BDC of a piston of a reciprocating compressor (a first step, step S31); and independently controlling the TDC and the BDC of the piston of the reciprocating compressor to fit the first and second reference positions, respectively (a second step, steps S32 and S33).

The second step (steps S32 and S33) includes reducing the TDC firing angle and the BDC firing angle when the TDC does not fit the first reference position.

The second step includes: first controlling the TDC of the piston of the reciprocating compressor so as to fit the first reference position (step S32); and controlling the BDC of the piston so as to fit the second reference position, when the TDC of the piston fits the first reference position (step S33).

In the second step, when the BDC does not fit the desired position, the TDC firing angle is increased and the BDC firing angle is reduced.

The second step includes: a first TDC control step of first controlling the TDC of the piston of the reciprocating compressor so as to fit the first reference position; and a first BDC control step of controlling the BDC so as to fit the second reference position, when the TDC of the piston fits the first reference position.

The second step includes: a second BDC control step of first controlling the BDC of the piston of the reciprocating compressor so as to fit the second reference position; and a second TDC control step of controlling the TDC of the piston so as to fit the first reference position, when the BDC of the piston fits the second reference position.

The second step includes: a third TDC control step of controlling the TDC of the piston of the reciprocating compressor so as to fit the first reference position; and simultaneously and independently controlling the BDC of the piston so as to fit the second reference position.

The TDC and the BDC values have values which are in inverse proportion to the size of the TDC and BDC firing angles. Namely, when the TDC firing angle is increased and the BDC firing angle is reduced, the TDC value is reduced and the BDC value is increased, in inverse proportion to the size of the respective firing angles. Conversely, when the TDC firing angle is reduced while the BDC firing angle is increased, the TDC value is increased and the BDC value is reduced, in inverse proportion to the size of the respective firing angles.

Referring to the relationship between the TDC and BDC firing angles, the value of the BDC firing angle being reduced is smaller than the value of the TDC firing value being increased.

In the step of making the TDC fit the first reference position, the TDC is controlled to be zero (0).

The method for controlling an operation of the reciprocating compressor will now be described in more detail as follows.

The TDC and BDC detecting unit 21 detects the TDC and the BDC of the piston of the reciprocating compressor (step S31). Herein, the TDC and BDC can be detected through various methods which would not be described in detail herewith.

Next, the microcomputer 24 controls the TDC to be in a pre-set position, preferably, to be zero (0) (TDC=0) while monitoring the detected TDC in real time (step S32). Namely, the microcomputer 24 calculates the stroke estimate value of the reciprocating compressor based on the voltage and current detected by the voltage and current detecting units 22 and 23, compares the calculated stroke estimate value and a stroke command value, and outputs a switching control signal to make the TDC of the piston of the reciprocating compressor zero (TDC=0) based on the comparison result and the detected TDC. Accordingly, by turning on or off a switch (e.g., a triac) according to the switching control signal, the TDC of the piston of the reciprocating compressor can become zero (TDC=0).

In this case, if the TDC is not zero, the TDC and BDC firing angles are reduced to increase the TDC. Namely, according to the method for controlling an operation of the reciprocating compressor of the present invention, the TDC which increases according to the reduction of the TDC firing angle is controlled to be zero (TDC=0).

When the TDC is zero, the microcomputer 24 controls the BDC so as to fit a desired position while monitoring the detected BDC in real time (step S33). Namely, the microcomputer 24 calculates the stroke estimate value of the reciprocating compressor based on the voltage and current detected by the voltage and current detecting unit 22 and 23, compares the calculated stroke estimate value and the stroke command value, and outputs the switching control signal to make the BDC of the piston of the reciprocating compressor position at a desired position based on the comparison result and the detected BDC. Accordingly, the switch (e.g., the triac) can be turned on or off according to the switching control signal to make the BDC of the piston of the reciprocating compressor come at the desired position. Herein, the desired position is determined by a size of the stroke according to the stroke command value.

In this case, if the BDC is not at the desired position, it is increased by increasing the TDC firing angle little by little and reducing the BDC firing angle. Namely, according to the method for controlling an operation of the reciprocating compressor in the present invention, the BDC which is increased according to the reduction of the BDC firing angle is controlled to reach the desired position. Herein, preferably, the TDC firing angle being increased is smaller than the BDC firing angle being reduced.

When the BDC reaches the desired position, the TDC and BDC firing angles at the time are maintained (step S34).

Figure 4:
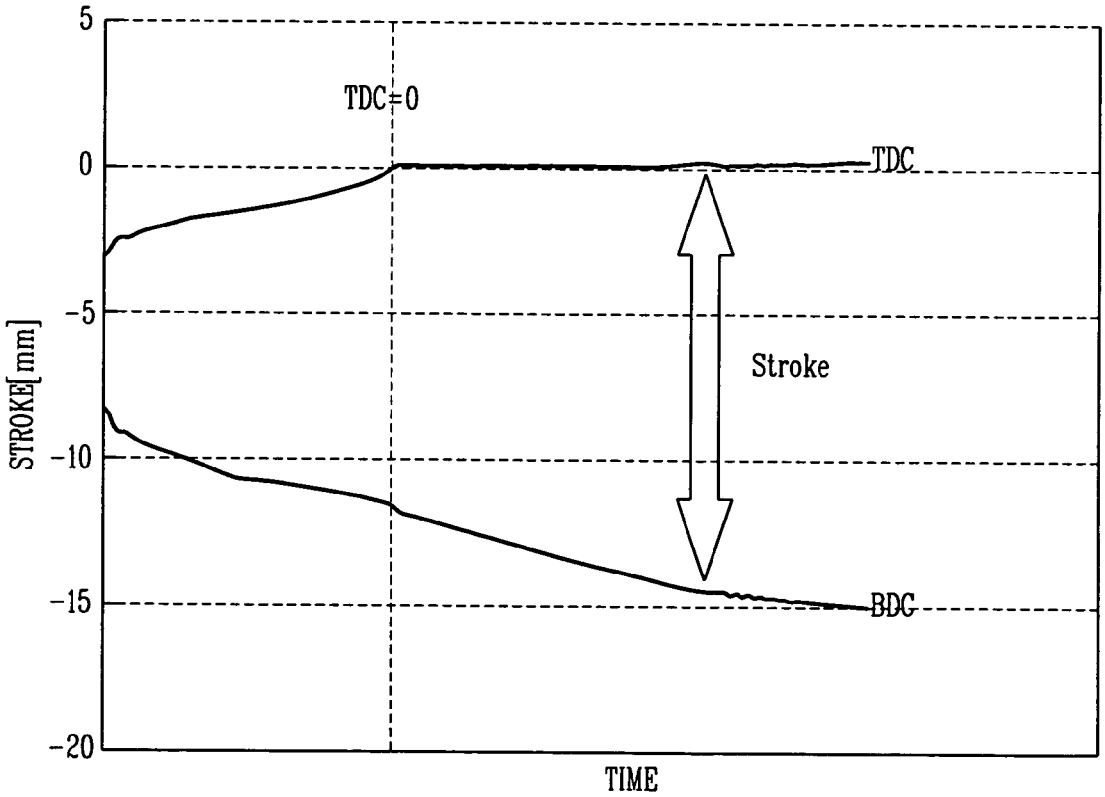
FIG. 4 is a graph showing a size of a stroke according to the present invention.

The size of the stroke according to the apparatus and method for controlling an operation of the reciprocating compressor according to the present invention is shown in FIG. 4.

FIG. 4 is a graph showing a size of the stroke according to the present invention.

As shown in FIG. 4, the apparatus and method for controlling an operation of the reciprocating compressor of the present invention can increase the size of the stroke so as to be larger than that of the related art.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. An apparatus for controlling an operation of a reciprocating compressor comprising:

a detector to detect a top dead center (TDC) position and a bottom dead center (BDC) position of a piston of the reciprocating compressor as the piston moves during a reciprocating cycle; and a controller to reset the TDC and the BDC independently from one another according to respective first and second reference positions, wherein at least one of the detected TDC position or the detected BDC position does not equal a respective one of the first or second reference positions, wherein the controller resets the TDC to correspond to the first reference position based on the detected TDC position and the detected BDC position and independently resets the BDC to correspond to the second reference position, and wherein the controller resets the BDC to correspond to the second reference position based on the detected TDC position and the detected BDC position and independently resets the TDC to correspond to the first reference position.

2. The apparatus of claim 1, wherein the controller controls the TDC to correspond to the first reference position based on the detected TDC position and the detected BDC position and simultaneously controls the BDC to correspond to the second reference position.

3. The apparatus of claim 1, wherein the controller independently controls a TDC firing angle and a BDC firing angle to make the TDC correspond to the first reference position and the BDC correspond to the second reference position.

4. The apparatus of claim 1, wherein the controller comprises:

voltage and current detectors to respectively detect voltage applied to the reciprocating compressor and current flowing at the reciprocating compressor;

a microcomputer for calculating a stroke estimate value based on the detected voltage and current, and outputting a switching control signal based on a result obtained by comparing the calculated stroke estimate value and a stroke command value; and a switch which is switched on or off according to the switching control signal to control at least one of the TDC or BDC.

5. The apparatus of claim 1, wherein the first and second reference positions are previously set in a look-up table in a storage unit.

6. The apparatus of claim 1, wherein each of the first and second reference positions are calculated by the microcomputer based on the TDC and the BDC detected according to an initial initiation and previously stored in a storage unit.

7. The apparatus of claim 4, wherein the switch is a thyrister for controlling a flow of current according to the switching control signal and input AC power.

8. The apparatus of claim 1, wherein the controller increases the TDC and decreases the BDC independently from one another to increase a stroke of the position during the reciprocating cycle.

9. The apparatus of claim 8, wherein the controller increases the TDC by a first amount and decreases the BDC by a second amount independently from one another.

* * * * *